US007328484B2

(12) United States Patent
Salice

(10) Patent No.: US 7,328,484 B2
(45) **Date of Patent: *Feb. 12, 2008**

(54) HINGE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/523,826

(22) Filed: Sep. 20, 2006

(65) Prior Publication Data

US 2007/0067958 A1 Mar. 29, 2007

Related U.S. Application Data

(62) Division of application No. 10/712,961, filed on Nov. 13, 2003, now Pat. No. 7,127,778.

(30) Foreign Application Priority Data

Nov. 13, 2002 (DE) ..... 202 17 546 U
Mar. 5, 2003 (DE) ..... 203 03 534 U

(51) Int. Cl.
*E05D 7/00* (2006.01)
*E05F 1/08* (2006.01)

(52) U.S. Cl. ..... 16/354; 16/288; 16/286

(58) Field of Classification Search ..... 16/354, 16/286–288, 294, 82, 54, 56, 50, DIG. 21; 292/336.3; 49/339–341, 348, 349; 188/80, 188/25, 290, 322.5

See application file for complete search history.

(56) References Cited

U.S. PATENT DOCUMENTS 283,416 A * 8/1883 Pattison ..... 16/311
2,078,815 A * 4/1937 Segar ..... 16/286
2,626,420 A * 1/1953 Lambert et al. ..... 16/79
4,426,752 A * 1/1984 Nakayama ..... 16/82
4,872,239 A * 10/1989 Ferguson et al. ..... 16/64
4,912,806 A * 4/1990 Orii et al. ..... 16/64
4,979,265 A * 12/1990 Grass ..... 16/291
5,040,857 A * 8/1991 Mandel et al. ..... 312/405

(Continued)

FOREIGN PATENT DOCUMENTS

DE 29614470 U1 * 10/1996

(Continued)

OTHER PUBLICATIONS

Patent Abstracts of Japan vol. 11, No. 175 (M-596), Jun. 5, 1987 & JP 62-006848, Jan. 13, 1987.

*Primary Examiner*—Chuck Y. Mah
(74) *Attorney, Agent, or Firm*—Dilworth & Barrese LLP

(57) ABSTRACT

The invention relates to a hinge comprising a moveable hinge section and a hinge section consisting of a fixed stop section, which are interconnected by at least one joint axis, and comprising a damping device mounted on one of the hinge sections whose translationally or rotatably moveable damping member is acted upon at least in the closure region of the hinge via gear means from the other hinge section. According to the invention for adjustment of the moveable damping member depending on the tilt of the moveable hinge section relative to the at least one joint axis, there is provided at least three moveable gear members are provided, of which one is the damping member itself.

14 Claims, 5 Drawing Sheets

U.S. PATENT DOCUMENTS

| | | | | | |
|---|---|---|---|---|---|
| 5,102,084 | A * | 4/1992 | Park | 248/286.1 |
| 5,195,210 | A * | 3/1993 | Lee | 16/54 |
| 5,500,985 | A * | 3/1996 | Klueger | 16/354 |
| 5,535,482 | A * | 7/1996 | Grabber | 16/286 |
| 6,408,483 | B1 * | 6/2002 | Salice | 16/85 |
| 6,536,080 | B2 * | 3/2003 | Bella et al. | 16/412 |
| 6,832,412 | B2 * | 12/2004 | Kim | 16/354 |

FOREIGN PATENT DOCUMENTS

| | | | |
|---|---|---|---|
| DE | 201 04 100 | | 5/2001 |
| DE | 202 05 905 | | 7/2002 |
| DE | 10305977 | A1 * | 9/2004 |
| EP | 595045 | A1 * | 5/1994 |
| EP | 1083276 | A1 * | 3/2001 |
| JP | 02266081 | A * | 10/1990 |

* cited by examiner

HINGE

CROSS-REFERENCE TO RELATED APPLICATION(S)

The present invention is a Divisional application of application Ser. No. 10/712,961 filed Nov. 13, 2003 now U.S. Pat. No. 7,127,778.

BACKGROUND OF THE INVENTION

The invention relates to a hinge, preferably for furniture, comprising a moveable hinge section and a hinge section consisting of a fixed stop section, which are interconnected by at least one joint axis, and comprising a damping device mounted on one of the hinge sections whose translationally or rotatably moveable damping member is acted upon at least in the closure region of the hinge via gear means from the other hinge section.

Hinges of this type are known from DE 201 04 100 U1 and DE 202 05 905 U1 wherein the damping devices consist of rotation dampers fixedly connected to a hinge section, whose pinions mesh with tilted toothed segments from the other hinge section. The known hinges thus have only two intermeshing gear members which can be twisted relative to one another to turn the damping member of the rotation damper, which in the closure region of the hinge can only turn the pinion of the rotation damper through a relatively small angle, which results in a correspondingly small damping of the closure movement of the door or flap carried by the moveable hinge section.

SUMMARY OF THE INVENTION

The object of the invention is thus to provide a hinge of the type specified initially whose damping device develops a higher damping force or damping action in the closure region of the hinge.

This object is solved according to the invention by the fact that in order to adjust the moveable damping member depending on the tilt of the moveable hinge section relative to the at least one joint axis, there is provided at least three moveable gear members of which one is the damping member itself.

The hinge according to the invention differs from the known hinges in that between the two gear members connected to the damping device on the one hand and to the moveable hinge section on the other hand there is arranged a third moveable gear member which is configured such that it considerably enlarges the damping path of the moveable damping member as a result of the gear ratio with respect to the swivel movement of the moveable hinge section in the closure region. The damping member can consist of a piston or a rotary piston in a known fashion.

According to a preferred embodiment it is provided that the damping device is a rotation damper whose damping member carries a pinion.

The central gear member supported on an axis of the hinge section preferably consists of two toothed segments concentrically curved with respect to the axis having a larger and a smaller radius, of which the toothed segment having the larger radius meshes with the pinion of the rotation damper and the toothed segment having the smaller radius meshes with a toothed segment whose swivel movement is derived from one of the hinge sections.

The damping device according to the invention can be used particularly advantageously with a double-joint hinge wherein the gear member is supported with two toothed segments on a fixed axis of the fixed hinge section and the toothed segment having the smaller radius meshes with a toothed segment connected to one of the connecting rods. The gear member is more suitably supported with two toothed segments on the fixed joint axis of one of the connecting rods wherein the toothed segment having the smaller radius meshes with a toothed segment connected to the other connecting rod.

The gear member with two segments is preferably symmetrical to a plane which runs through the centre of the two toothed segments. This configuration results in easier assembly and reduces the number of parts to be supplied.

The central gear member need not necessarily have two toothed arms. Other engaging pieces can also be provided on the gear member, which can be brought into engagement with complementary engagement pieces on the damper-side gear member or the gear member on the hinge section side. According to a preferred embodiment of the invention, the central gear member can have two arms which extend radially away from the axis of rotation of the gear member, on which projecting ends suitable engaging pieces are constructed. In this case, by analogy with the toothed segments having smaller and larger radii, the gear member preferably has an engaging piece having a larger lever arm and an engaging piece having a smaller lever arm with respect to the axis of rotation, wherein the engaging piece having the larger lever arm can be brought into engagement with the damper-side gear member and the engaging piece having the smaller lever arm can be brought into engagement with the gear member on the hinge section side. It is hereby ensured that a small movement of the gear member on the hinge section side is translated into a larger movement of the damper-side gear member and a greater damping action is thereby achieved.

According to a preferred embodiment of the invention, said central gear member can, on the one hand, have a toothed profile curved concentrically with respect to the axis of rotation, that engages with the pinion of the rotation damper and, on the other hand, as a second engaging piece said central gear member can have a fork-shaped engaging recess which can be brought into engagement with a suitable engaging projection of the gear member on the hinge section side. In mechanical inversion, the engaging recess can also be provided on the gear member on the hinge section side wherein a suitable engaging projection is then provided on the engaging piece of the central gear member. According to one embodiment of the invention, the two engaging pieces of the central gear member and the gear member on the hinge section side can also be constructed such that they are only in engagement over a part section of the swivel path of the moveable hinge section, especially when the hinge is moved into its closed position. The two engaging pieces then preferably come into engagement at least 20° to 30° before reaching the completely closed position so that a corresponding damping action is achieved.

An increased damping action can also be achieved by not only the central gear member having engaging pieces with different effective lever arms. According to an embodiment of the invention, the gear member on the hinge section side, which is rotatably supported about an axis on the same hinge section as the damping device can also have an engaging piece which meshes with the engaging piece of the central gear member, which has a longer lever arm than the engaging piece of said central gear member. The point of engagement between the gear member on the hinge section side and the central gear member is thus closer to the axis of rotation of the central gear member than the axis of rotation of the gear member on the hinge section side. A small movement of the gear member on the hinge section side is hereby translated into a larger movement of the central gear member.

The gear member on the hinge section side can be affixed directly to the hinge section which does not carry the damper. In a double-joint hinge the gear member on the hinge section side can be affixed directly to one of the connecting rods which connect the two hinge sections.

In an alternative embodiment of the invention however, there can also be provided a separate gear member on the hinge section side which is rotatably supported on the hinge section to which the damping device is affixed and can be brought into engagement on the one hand with the central gear member and on the other hand with the respectively other hinge section which does not carry the damping device. A further translation possibility whereby the damping action can be increased is hereby achieved.

The separate gear member on the hinge section side preferably has an engaging projection which in the open position of the hinge projects into the swivel path of the hinge section or the corresponding connecting rod and on closure of the hinge is actuated by said hinge section or the connecting rod. In this case, a forced actuation can be provided in both directions wherein the gear member on the hinge section side is in fixed engagement with the hinge section. In an alternative embodiment of the invention, it can also be provided that the hinge section only presses the gear member or its engaging projection in the desired direction when closing the hinge. In order to achieve a corresponding movement of the damping device on opening the hinge, in a further development of the invention, a suitable pre-stressing device, especially a spring, can be provided to pre-stress the damping device in a position corresponding to the open position of the hinge. In this case, the pre-stressing device again presses the engaging projection into the swivel path of the hinge section so that the desired damping action occurs on re-closing. More advantageously, the spring does not act on the damping device itself but indirectly via the central gear member and/or the gear member on the hinge section side. The inhibition of the damping device can hereby be overcome with only a small amount of pre-stressing.

In a further development of the invention the axes of rotation of the gear members and/or the axis of rotation of the rotation damper can be parallel to the swivel axis or the swivel axes of the two hinge sections. In an alternative further development of the invention, the axes of rotation of the gear members and/or the axis of rotation of the rotation damper can, however, also be arranged perpendicular to the swivel axes of the hinge sections, especially if the gear member on the hinge section side is constructed separately in the fashion described previously. The gear members and the damping device can in this case be arranged on a hinge section constructed as a hinge cup wherein preferably one flange of the hinge cup covers the damping device and the gear members.

In order to achieve an increased damping action, two or a plurality of separate damping devices, especially rotation dampers can also be provided, which are actuated simultaneously. Preferably all the damping devices are then in engagement with the central gear member so that said member actuates all the dampers. In this case, rotation dampers, each bearing a pinion, can more suitably be provided. The pinion can engage with the circular-arc-shaped toothed segment of the central gear member.

According to another preferred embodiment it is provided that the hinge is provided with a closing device which overcomes the damping force. This embodiment ensures that the hinge according to the invention always reaches its closed position and for example, a door or flap provided with the hinge according to the invention is completely drawn into its closing position after the damping action has completed.

BRIEF DESCRIPTION OF THE DRAWINGS

An exemplary embodiment of the invention is explained in detail below with reference to the drawings. In the figures.

DESCRIPTION OF THE PREFERRED EMBODIMENTS

Figure 1:
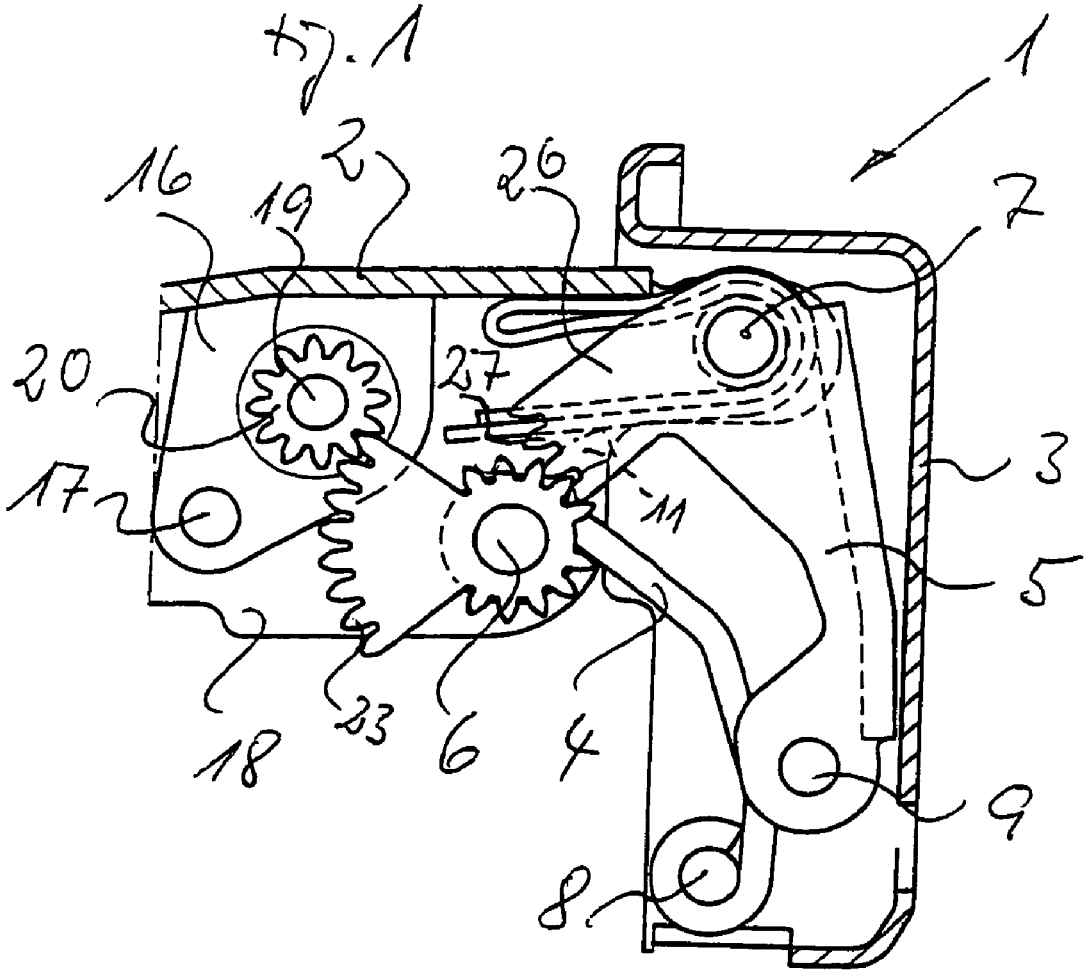
FIG. 1 shows a section through a hinge according a preferred embodiment in its closed state.

The hinge according to the invention will be explained below with reference to a four-joint or double-joint hinge.

The double-joint hinge 1 usually consists of a U-shaped hinge arm 2 which can be positioned against a bearing wall and a swivellable cup-shaped hinge section 3 connectable to a door or flap, which is flexibly connected to the hinge section 2 by an inner connecting rod 4 and an outer connecting rod 5 having a U-shaped cross-section. The connecting rods 4, 5 are supported on the one hand on the joint axes of the hinge arm 2 and on the other hand on the joint axes 8, 9 of the cup-shaped hinge section 3 in the usual fashion. Bent out from the inner rolled-up bearing eye 10 of the inner connecting rod 4 is a tongue 11 forming a cam which slides in a fashion which can be seen from FIGS. 3 to 5 on the inner leg of the of the double-layer hairpin-shaped locking spring 12 which is held between the legs 13 of the U-shaped connecting rod 5 on the joint axis 7 and is supported with its outer leg on the cross-piece 14 of the hinge arm 2. So far the double-joint hinge 1 is of known design.

The damping device according to the invention consists of a rotation damper whose housing 16 is constructed as polygonal and abuts with one side against the cross-piece 16 of the hinge arm 2 so that it is only connected to the hinge arm 2 by a bolt 17 inserted through a hole in the housing, which is held in holes in the leg 18 of the hinge arm 2.

Figure 2:
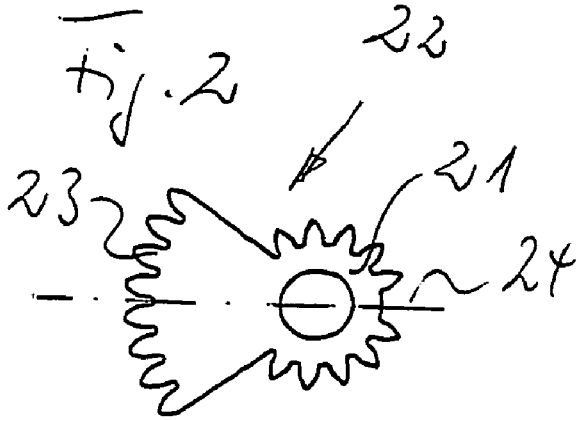
FIG. 2 shows a top view of the central moveable member of the gear which transmits the closing movement of the moveable hinge section to the rotation damper.

Pinions 20 are keyed onto the pins 19 of the rotatable damping member which project on both sides of the housing 16. Toothed segments 21 of a gear member 22 enclosing the bearing eye in a fork-shaped fashion on both sides of the inner rolled-up bearing eye of the inner connecting rod 4 are supported on the axial pin 6, which segments can be interconnected by a cross-piece not shown and extend in their plane into toothed segments 23 which for their part enclose the housing 16 of the rotation damper in a fork-shaped fashion and mesh with the pinions 20. The gear member 22 is symmetrical, in a fashion which can be seen from FIG. 2, to a diameter plane 24 which runs through the central regions of the toothed segments 21, 23. The ratio of the radii of the toothed segments 21 having the smaller diameter to the toothed segments 23 having the larger diameter can be 1:1.5 to 1:3, and in the exemplary embodiment shown is 1:2.

The legs of the outer U-shaped connecting rod 5 are provided with extensions 26 projecting beyond the fixed joint axis 7, which run at an angle to the cross-piece of the connecting rod 5 and are provided at their free ends with toothed segments 27 which mesh with the toothed segments 21.

Figure 3:
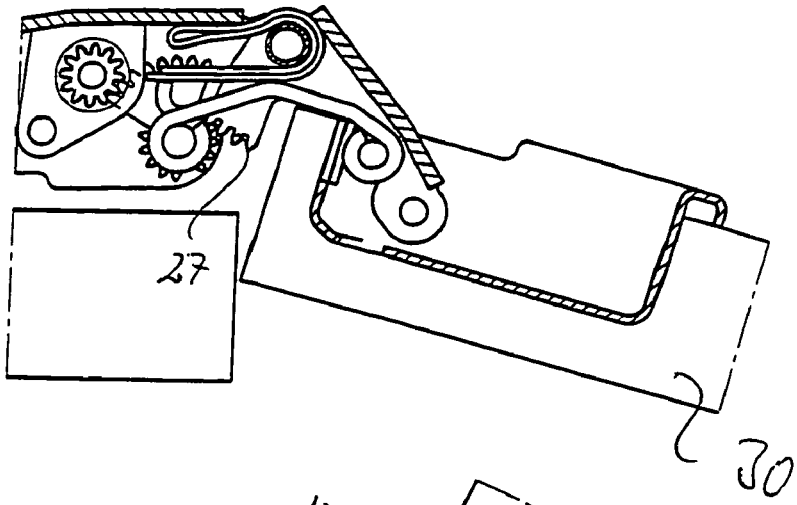
FIGS. 3-5 show diagrams corresponding to FIG. 1 of the hinge in different positions between its opening and closing position.
Figure 4:
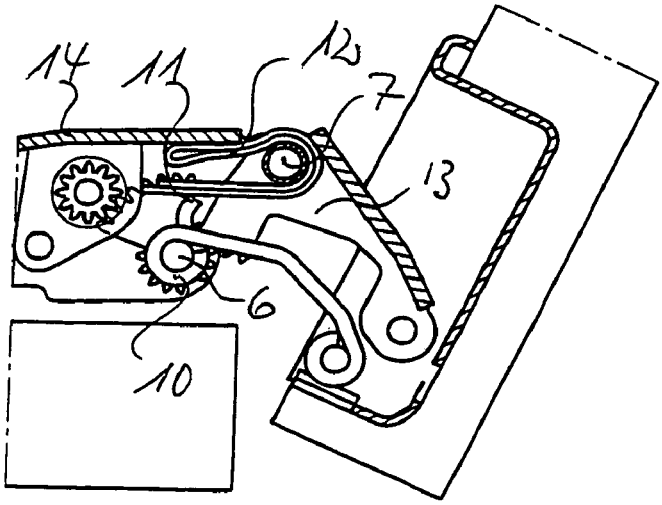
Figure 5:
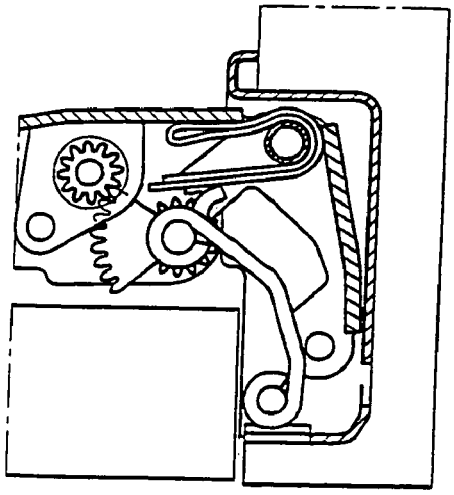

As can be seen from FIGS. 3 to 5, the toothed segment 27 makes only a small swivel movement between the open position of a door 30 which can be seen from FIG. 3 to the closing position of the door which can be seen from FIG. 4 whereas the swivel movement of the toothed segment 27 in the closure region of the door between FIG. 4 and FIG. 5 is substantially larger but is still so small that in order to achieve an improved damping action, the gearing according to the invention is required, which imparts a rotary movement over an enlarged angular range to the damping member of the rotation damper. In the exemplary embodiment shown, this rotary movement approximately corresponds to an angular range of 60° to 70° of the toothed segment 23 whereas the extensions 26 of the outer connecting rod 5 provided with the toothed segments 27 in the closure region only cover an angular range of approximately 30° in the exemplary embodiment shown. Since the radius of the toothed segment 23 is larger than the radius of the pinion 20 of the rotation damper, the rotation damper can develop an appreciable damping action in the closure region of the hinge. The radius of the toothed segment 23 is preferably at least twice the radius of the pinion 20 of the rotation damper.

Figure 6:
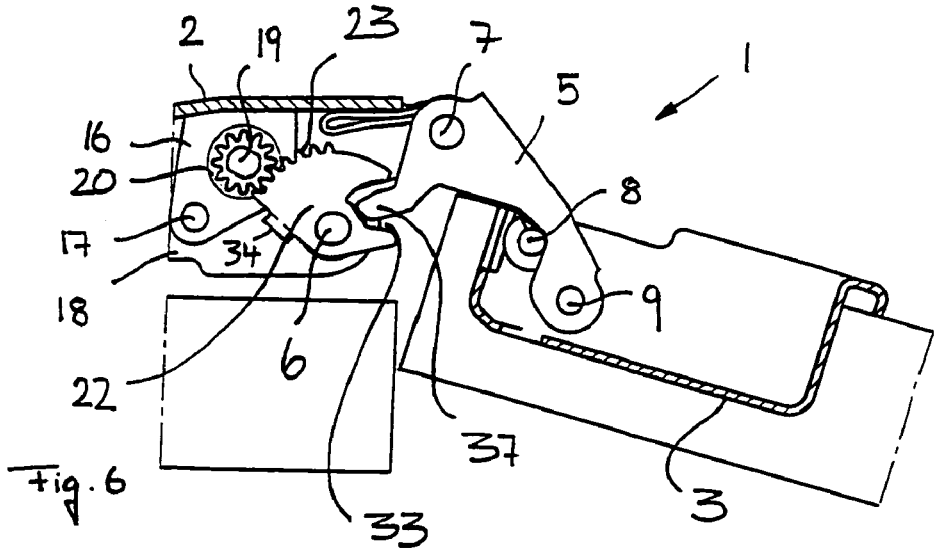
FIGS. 6-8 show diagrams corresponding to FIGS. 3-5 of a hinge according to a further preferred embodiment of the invention in different positions between its opening and closing position.
Figure 7:
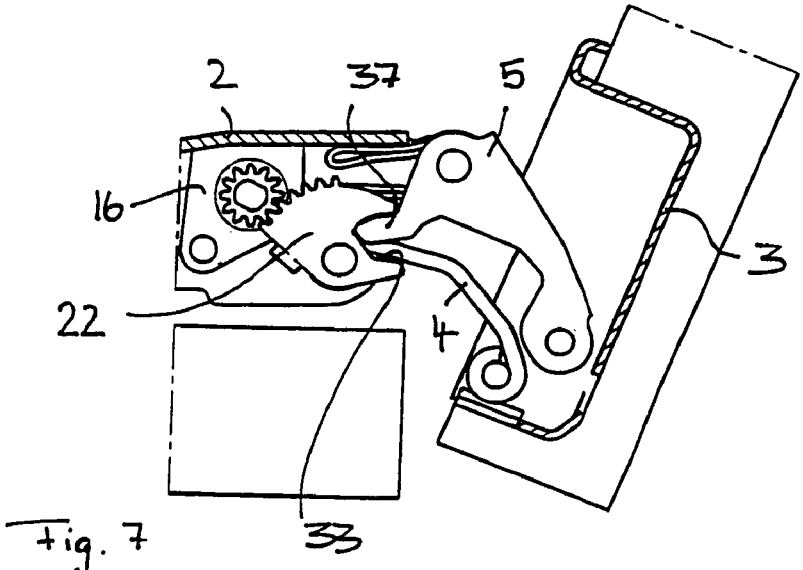
Figure 8:
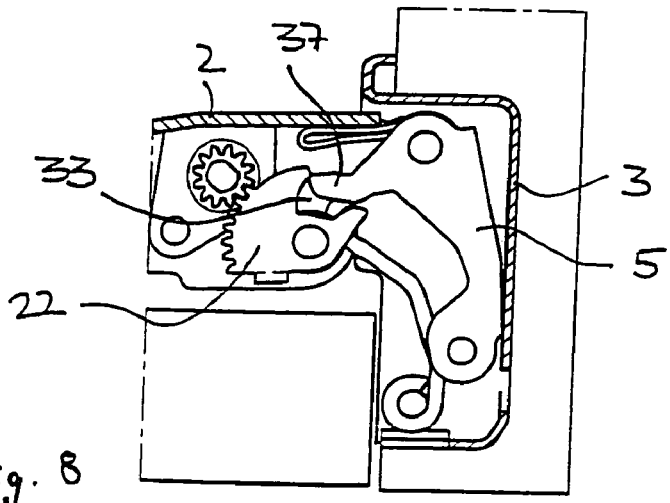

The hinge shown in FIGS. 6 to 8 substantially corresponds to the hinge shown in FIGS. 1 to 5 so that the same reference numbers are used for corresponding components and in this respect, reference is made to the previous description. The hinge according to FIGS. 6 to 8 differs substantially from the hinge described previously by the construction of the central gear member and the gear member on the hinge section side constructed on one of the connecting rods.

As shown in FIG. 6, the central gear member 22 is again located on the joint axis 6 on which the inner connecting rod 4 is pivoted. In the fashion described previously said member has the toothed segment 23 curved concentrically with respect to the axis 6, which meshes with the pinion 20 located on the rotation damper 16. However, for the gear connection with the connecting rod 5 there is provided not a curved toothed segment but an engaging piece in the form of a recess 33 which is bounded by two fork-shaped projections on an extension running radially to the axis 6. As shown in FIG. 6, the engaging piece 33 has a smaller lever arm with respect to the axis of rotation 6 than the engaging piece 23 in the form of the toothed segment meshing with the pinion 20. The hinge arm 5 engages in the recess of the engaging piece 33 with an engaging projection 37 which forms the gear member on the hinge section side and derives its movement from the hinge section 3. The connecting rod 5 is so to speak constructed as an elbow lever with respect to the axis 7. The lateral extensions of the outer connecting rod 5 are constructed as lever arms which enter into the suitably shaped recesses 33 of the sections of the central gear member 22 interconnected by a cross-piece 34. It is to be understood that the recess 33 and the lever arm 37 can also be arranged inversely on the connecting rod 5 and the gear member 22.

As can be seen from FIG. 6, in the open region of the hinge the lever arm 37 of the connecting rod 5 can swivel freely in the recess 33 without any movement of the moving member 22 being induced so that the rotation damper 16 remains ineffective.

Only on reaching the position shown in FIG. 7, which corresponds to a door angle of approximately 20° to 25°, does the upper edge of the lever arm 37 rest against the upper edge of the recess 33 so that the gearing can exert its effect during the closing movement and actuates the rotation damper 16.

During the opening movement of the door the lower edge of the lever arm 37 rests against the opposite lower edge of the recess 33 so that the gear member is guided back into the position according to FIG. 6.

Figure 9:
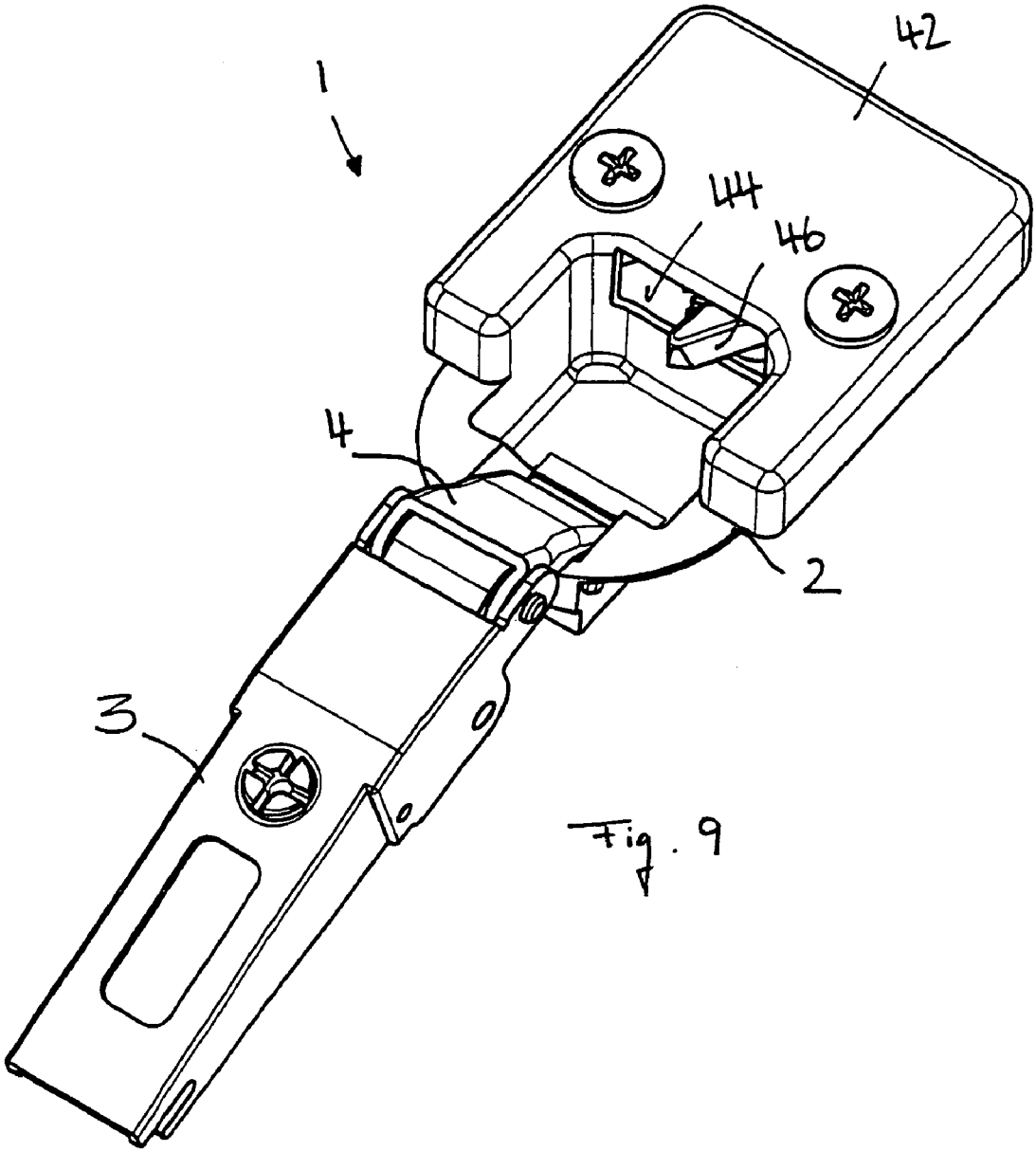
FIG. 9 shows a perspective view of a hinge according to a further preferred embodiment of the invention wherein the damping device and the gear members are affixed to a hinge section constructed as a hinge cup.
Figure 10:
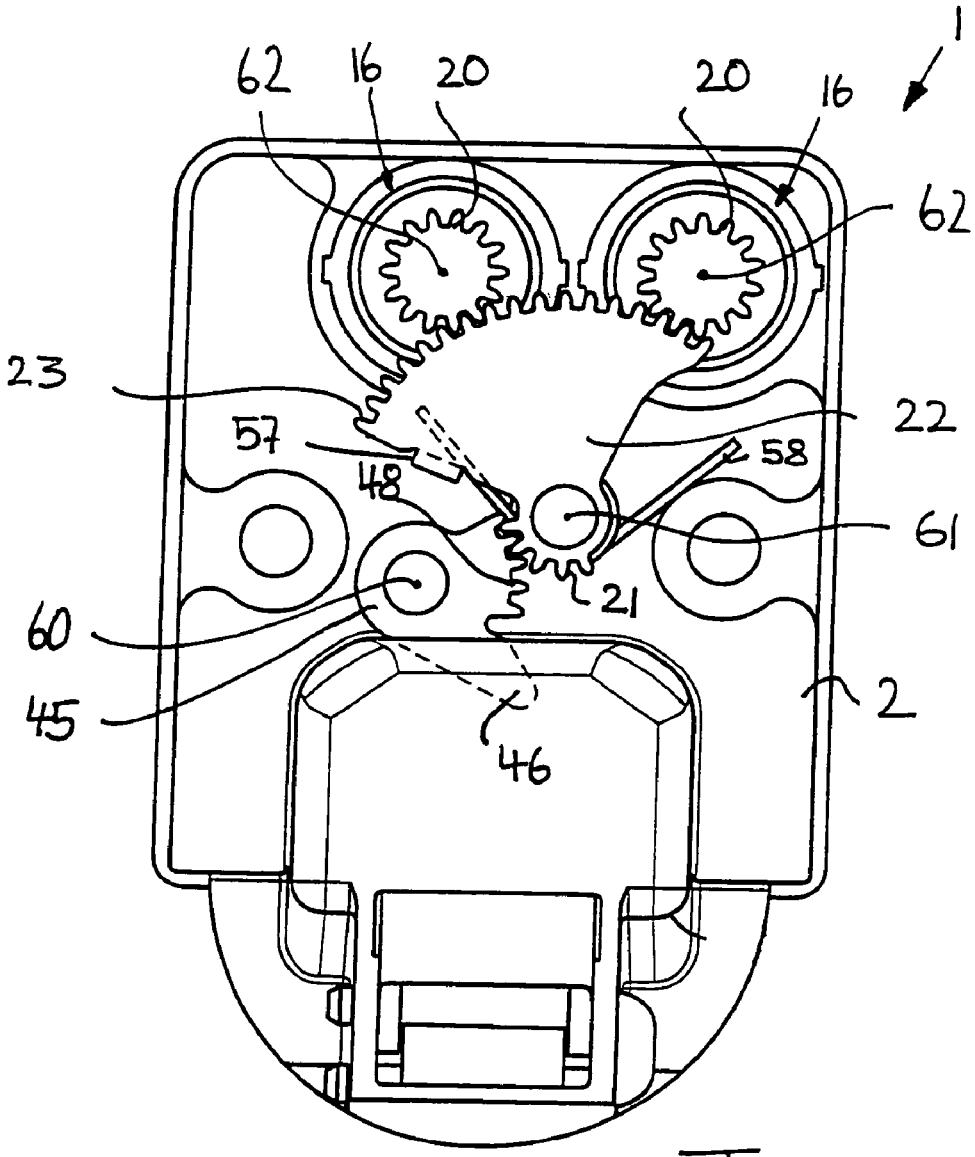
FIG. 10 shows a top view of the hinge cup of the hinge from FIG. 9
Figure 11:
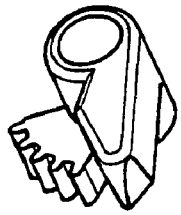
FIG. 11 shows a perspective view of the third gear member arranged on the hinge section side to actuate the damping device of the hinge from FIGS. 9 and 10.

In the hinge shown in FIGS. 9 to 11, the damping device 16 and the gear members 20, 22 and 45 are affixed to a hinge section 2 constructed as a hinge cup and in contrast to the embodiments of the invention described previously, have no axes of movement parallel to the hinge axes but swivel axes 62, 61 and 60 perpendicular thereto.

As shown in FIG. 9, the hinge comprises the hinge section 2 constructed as a hinge cup and the hinge section 3 pivoted thereon. Although the hinge section 2 constructed as a hinge cup is usually affixed to the moveable furniture part and the hinge section 3 shown is affixed to the fixed furniture part, for a better understanding because of the relative movement these parts can conversely be regarded as respectively fixed or moveable hinge sections so that the hinge sections in FIG. 9 have retained the same numbering of the corresponding respectively fixed and moveable hinge sections from FIG. 1. The pivotable hinge section 3 can thus be pivoted about the swivel axes defined by the connecting rods 4, 5 in the hinge cup 2 and swivelled out therefrom into the open position wherein FIG. 9 shows the swivelled-out position.

The damping device comprising two separate rotation dampers 17 is supported on the fixing flange 42 of the cup-shaped hinge section 2. Located on the axes of rotation 62 of the two rotation dampers 16 are pinions 20 which mesh with a common engaging piece in the form of a toothed segment 23 of the central gear member 22 arranged concentrically to its axis of rotation 61. The central gear member 22 furthermore has as a second engaging piece a toothed segment 21 also arranged concentrically to the axis of rotation 61 which however has a substantially smaller lever arm with respect to the axis of rotation 61 than the toothed segment 23 meshing with the pinions 20.

The toothed segment 21 of the central gear member 22 meshes with a third gear member 45 on the hinge section side, which has as an engaging piece a corresponding toothed segment 48 arranged concentrically to the axis of rotation 60 of the third gear member 45. As can easily be identified from FIG. 10, the point of engagement of the gear members 22 and 45 is substantially closer to the axis of rotation 61 of the central gear member 22 than to the axis of rotation 60 of the gear member on the hinge section side so that a corresponding translation of the movement of the gear member 45 is accomplished. A small movement of the gear member 45 is sufficient to achieve a substantially larger rotary movement of the central gear member 22. This is again re-translated into an even larger rotary movement of the pinions 20 and thus of the rotation damper 16.

The gear member 45 on the hinge section side has as a second engaging piece a lever arm 46 running radially away from the axis of rotation 60, which comes out through an opening 44 between the fixing flange 42 and the cup of the hinge section 2. The lever arm 46 thus projects into the cup-shaped recess of the hinge section 2 into which the hinge section 3 fits in the closed position of the hinge. The lever arm 46 thus lies in the swivel path of the hinge section 3 so that the later actuates the gear member 45 when the hinge is closed.

As can easily be identified from FIG. 9, the gearing and thus the damping device 16 is actuated just before complete closure of the hinge. If the lever arm 46 is pressed into the opening 44, the gear member 45 turns about its axis 60. The intermeshing toothed segments 48 and 21 bring about a corresponding rotation of the central gear member 22 about its axis of rotation 61. The pinions 20 and thus the rotation dampers 16 are hereby correspondingly driven via the toothed segment 23.

A bent lug 57 is acted upon by a leg spring 58 which presses the gearing into the extended position according to FIG. 9 when the hinge is opened.

In an advantageous embodiment of the invention the hinge cup 9 is made of die-cast zinc and has fixed bolts which form the swivel axes 60 and 61 for the gear members 22 and 45. The latter can be keyed onto the bolt or riveted or suitably fixed in another fashion.

The invention claimed is:

1. A hinge (1), comprising a first movable hinge section (3), a second hinge section (2) including a fixed stop section, at least one joint axis interconnecting said first and second hinge sections (3, 2), a damping device mounted upon one of said first and second hinge sections (3, 2) and comprising at least one damping member (16) mounted for rotational movement, gear means mounted for acting upon said at least one damping member (16) at least in a region of a closed position of said hinge (1), said gear means comprising at least three movable gear members (20, 22, 45), an axis (61) positioned upon one of said hinge sections (2, 3) for supporting one of said gear members (22) intermediately-mounted between said two other gear members (20, 45) of said at least three gear members (20, 22, 45), said intermediately-mounted gear member (22) comprising two separate engaging members (21, 23) arranged (i) concentrically about said axis (61) supporting said intermediately-mounted gear member (22), (ii) at a periphery of said intermediately-mounted gear member (22), and (iii) at unequal distance from said axis (61) supporting said intermediately-mounted gear (22), with one of said engaging members (23) mounted further from said axis (61) arranged to engage one (20) of said gears (20, 22, 45) contacting said damping member (16), said other engaging member (21) mounted closer to said axis (61) arranged to engage the other (45) of said gears (20, 22, 45), and said other (45) of said gear members (20, 22,45) being rotatably mounted upon an axis (60) situated upon said hinge section (2) on which said damping device (16) is mounted and arranged to engage both said intermediately-positioned gear (22) and other hinge section (3).

2. The hinge of claim 1, wherein said engaging members (21, 23) are constituted by toothed segments (21, 23) concentrically-curved with respect to said axis (61) upon which said intermediately-positioned gear (22) is mounted and having different radii of curvature, with one of said engaging members (23) mounted further from said axis (61) having the larger radius of curvature and said other engaging member (21) mounted closer to said axis (61) having the smaller radius of curvature, and said other (45) of said gears (20, 22, 45) being rotatably mounted and comprising a toothed segment (48) arranged to engage said toothed segment (21) having the smaller radius of curvature.

3. The hinge of claim 2 wherein ratio of said smaller: larger radii is from 1:1.5 to 1:3.

4. The hinge of claim 1, wherein said damping member (16), and other (45) of said gears (20, 22, 23) are both rotatably mounted upon said fixed hinge section (2).

5. The hinge of claim 1, wherein said other (45) of said gear members (20, 22, 45) comprises a projection (46) arranged to project into a swivel path of said movable hinge section (3) in open position of said hinge (1) and be actuated by said movable hinge section (3) upon closing of said hinge (1).

6. The hinge of claim 5, additionally comprising a spring (58) arranged to pre-stress said damping device (16) in the open position of said hinge (1) and act upon at least one of said intermediately-positioned and other gear members (22, 45).

7. The hinge of claim 6, wherein said projection (46) is constituted by a lever arm (46) extending radially away from the axis of rotation (60) thereof and projecting through an opening (44) of a cup-shaped recess of the fixed hinge section (2) on which said other gear (45) is mounted, such that the lever arm (46) lies in a swivel path of the movable hinge section (3) which actuates said other gear member (45) upon closing.

8. The hinge of claim 1, wherein one (2) of said hinge sections (2,3) to which at least one of said damping device (16) and gear members (22, 45) are affixed, is constructed as a hinge cup having a flange.

9. The hinge of claim 1, wherein at least one of said damping device (16) and three gear members (20, 22, 45) comprises a pivoting axis (62, 61, 60) extending substantially normal to said joint axis.

10. The hinge of claim 1, wherein said damping device comprises a plurality of damping members (16, 16), and said engaging member (23) mounted further from said axis (61) of said intermediately-positioned gear member (22) is arranged to actuate all said damping members (16), in common.

11. The hinge of claim 1, wherein said intermediately-mounted gear (22) and other gear member (45) are arranged to engage at an angular position 20°-30° before reaching a completely-closed position of said hinge (1) to provide damping action.

12. The hinge of claim 1, wherein a gear (20) of said three gears (20, 22, 45) contacting said damping member (16) is a pinion keyed onto said damping member (16).

13. The hinge of claim 12, wherein said damping device comprises two rotation dampers (16) mounted upon respective axes of rotation (62), and said gear means comprise two pinions (20) each being mounted upon the respective axis of rotation (62) of the rotation damper (16) and meshing with the engaging member (23) of said intermediately-positioned gear mounted further from the axis of rotation (61) thereof.

14. The hinge of claim 1, wherein said other gear (45) additionally comprises a lever arm (46) extending radially away from the axis of rotation (60) thereof and projecting through an opening (44) of a cup-shaped recess of the hinge section (2) on which said other gear (45) is mounted, such that the lever arm (46) lies in a swivel path of the movable hinge section (3) which actuates said other gear member (45) upon closing.

* * * * *